United States Patent [19]

Tang

[11] Patent Number: 5,007,872

[45] Date of Patent: Apr. 16, 1991

[54] SCREENED INTERCONNECT SYSTEM

[75] Inventor: Sang T. Tang, Pomona, Calif.

[73] Assignee: Babcock Display Products, Inc., Anaheim, Calif.

[21] Appl. No.: 364,629

[22] Filed: Jun. 12, 1989

[51] Int. Cl.[5] ..... H01J 9/00

[52] U.S. Cl. ..... 445/25; 361/412

[58] Field of Search ..... 445/24, 25; 361/412

[56] References Cited

U.S. PATENT DOCUMENTS 3,873,169 3/1975 Miyamoto et al. ..... 445/24
3,931,436 1/1976 Kupsky ..... 445/25 X
3,936,930 2/1976 Stern ..... 361/412
4,124,926 11/1978 Kupsky ..... 445/24
4,407,658 10/1983 Bernot et al. ..... 445/25

*Primary Examiner*—Kenneth J. Ramsey
*Attorney, Agent, or Firm*—G. Donald Weber, Jr.

[57] ABSTRACT

An interconnect system which is used to provide an electrical connection between contact pads on the facing surfaces of adjacent electrical support media such as the face plate and the substrate of an electronic circuit device such as gas discharge displays. The interconnect system uses a conductive glass material which is selectively screened onto and fired with the display device.

15 Claims, 1 Drawing Sheet

SCREENED INTERCONNECT SYSTEM

BACKGROUND OF THE INVENTION

1. Field of the Invention

This invention is directed to electrical interconnect systems, in general, and to a screened-on, conductive-glass, interconnect system, in particular, for use between contact pads of adjacent (usually parallel) surfaces of electronic devices.

2. Prior Art

In the electronic industry, there are many types of electronic elements or devices which utilize leads or terminals which extend therefrom. These types of leads are found in many integrated circuit devices or packages as well as many other types of assemblies. These leads are often used to effect an interconnection between an internal portion of the device and an external source, a utilization device, or the like.

One type of device or assembly which uses this type of lead or terminal is a display device. Typical examples of the display devices so constructed are plasma discharge displays, liquid crystal displays, or other types of gas discharge displays. These displays comprise a sealed envelope having a material enclosed therein which material is capable of being excited or activated to thereby change a characteristic thereof. The envelope includes a pair of plates (usually referred to as the faceplate and the substrate) on which electronic conductors are disposed by any one of many processes such as material deposition, material etching, material screening or the like. The plates are spaced apart whereupon the conductors thereon produce an electric field therebetween whenever the conductors are energized by the application of electrical signals thereto. The electric field is also produced through or across the activation material (gas, liquid crystal or the like) which is disposed between the plates. The electric field operates to alter the state of the material so as to effect a display. That is, the material is aligned to control light passing therethrough, to glow, or the like.

The construction of these types of devices using faceplates, substrates, and a sealing arrangement therebetween is well known in the art. However, the designs of the display, especially as related to the terminals, and the method of assembling the display and terminals is an area of constant investigation in order to improve the operation of the device and to reduce the cost of fabrication thereof.

PRIOR ART STATEMENT

A search of the prior art has uncovered the following patents which are listed in numerical order:

U.S. Pat. No. 3,979,623; INDICATOR DISPLAY TUBE; Y. Yanagisawa et al. This patent is directed to an indicator display tube with cathode segments connected in parallel and energized sequentially.

U.S. Pat. No. 4,039,882; EDGE TERMINATIONS FOR GAS DISCHARGE DISPLAY PANEL; G. Kupsky et al. This patent is directed to a gas discharge display device with printed conductors passing through a seal area between the substrates.

U.S. Pat. No. 4,124,926; EDGE TERMINATIONS FOR GAS DISCHARGE DISPLAY PANEL DEVICE AND METHOD OF MANUFACTURING SAME; G. Kupsky et al. This patent is directed to a gas discharge display panel including a pair of parallel, spaced apart substrates with printed conductors thereon which extend through the seal area on the respective substrates and having a conductive epoxy extruded into the space between the conductors on the spaced apart substrates.

U.S. Pat. No. 4,139,250; GAS DISCHARE DISPLAY PANEL AND METHOD OF MANUFACTURING THE SAME; J. Jacobs et al. This patent is directed to a method of making a gas discharge display device.

U.S. Pat. No. 4,270,823; METHOD OF FORMING CONDUCTORS IN SLOTS IN A PLATE; P. Kuznetzoff. This patent is directed to a method of forming conductors in a groove in a plate.

U.S. Pat. No. 4,449,949; METHOD OF MANUFACTURING A FLAT-TYPE FLUORESCENT DISPLAY TUBE; G. Eto et al. This patent is directed to a method of manufacturing a fluorescent display device.

U.S. Pat. No. 4,599,076; METHOD OF PRODUCING DISCHARGE DISPLAY DEVICE; S. Yokono et al. This patent is directed to a method of making a discharge desplay device using thick film techniques with a $LaB_6$ cathode.

U.S. Pat. No. 4,614,668; METHOD OF MAKING AN ELECTROLUMINESCENT DISPLAY DEVICE WITH ISLANDS OF LIGHT EMITTING ELEMENTS; M. Topp et al. This patent is directed to an EL display with a matrix of conductors with light-emitting elements at junctions of said conductor matrix.

U.S. Pat. No. 4,763,233; NON-SOLDERED LEAD APPARATUS; S. T. Tang. This patent is directed to a display apparatus which are includes terminals which hermetically sealed into the structure of the apparatus during the assembly thereof. The terminal includes a resilient end portion which makes contact with electrical conductors on the face plate.

SUMMARY OF THE INSTANT INVENTION

This invention is directed to a screened-on interconnect system which is designed to replace the metal spring or conductive epoxy interconnects which are used in most of the currently available devices which use electrical contacts between a faceplate and a substrate. The screened-on interconnect system consists of, inter alia, a conductive solder glass which is screened onto a substrate and fired with an appropriate temperature profile whereby the solder glass forms a conductive path between the contact pads on the faceplate and substrate, respectively. The screened-on interconnect is especially useful in gas discharge displays and the like which require higher density in the connections between the faceplate and the substrate than is readily accomplished with the current method of metal spring contact and/or conductive epoxy interconnections. The interconnect system uses thick film screening processes and has a relatively wide process and operating temperature range. It also permits a high density interconnection arrangement.

DESCRIPTION OF THE PREFERRED EMBODIMENT

Figure 1:
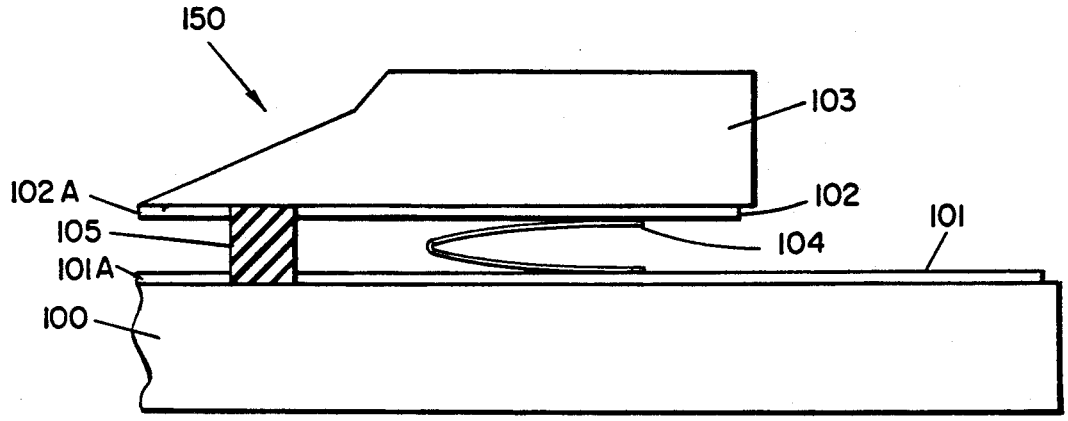
FIG. 1 PRIOR ART
FIG. 1 is a cross sectional view of a portion of a typical apparatus using the metal spring contacts of the prior art.

Referring now to FIG. 1, there is shown a partial view of a cross-section of a display device known in the art and which uses a metal spring 104 as the electrical connection between the conductor pads 101 and 102.

More particularly, FIG. 1 depicts a typical display device 150. The display device includes a substrate 100 and a faceplate 103. The substrate and faceplate are disposed substantially in parallel, spaced apart arrangement relative to each other. Typically, the substrate 100 and the faceplate 103 are fabricated of glass, plastic or any other substantially transparent, electrically insulative, and rigid material.

The facing surfaces of the substrate and faceplate include one or more conductor pads 101 and 102, respectively. Typically, the conductor pads are elongated strips or paths of an electrically conductive material such as tin oxide or the like. The substrate 100 and faceplate 103 are joined together by the seal 105. Typically, the seal 105 is made of a glass frit or the like. The seal 105 extends around at least a portion of the space between the substrate 100 and the faceplate 103. Thus, an enclosed chamber (only a portion of which is shown in the Figure) is provided. The enclosed chamber is used to maintain and retain the activatable material. The material can be a liquid crystal, a gas or the like. An appropriate gas such as neon, argon, fluorescent material or the like issued to produce the appropriate glow, as desired, in response to an electrical field therethrough. Also, within the chamber are the electrical conductors 101A and 102A which may represent lead lines, display elements (i.e. anodes and/or cathodes) or the like by which the electrical field is selectively generated. This construction is conventional and is described in the prior art including the above mentioned patent to S. T. Tang.

The internal conductors 101A and 102A are electrically joined to (or continuations of) the conductors 101 and 102, respectively. The conductors 101 and 102 are referred to as conductor pads and are used, inter alia, as terminals for the display device 150. For example, the substrate 100 extends beyond the edge of faceplate 103. Thus, the conductor pads 101 are, in essence, exposed. In some instances, the substrate 100 with the conductor pads 101 thereon is adapted to be inserted into a suitable receptacle or socket. In other cases, a suitable connector (not shown) is arranged to abut the conductor pads 101. The conductor pads 101 and 102 are, selectively, connected together in order to transfer electrical signals from the external terminals to the conductor pads 101 and 102 and, thus, to the internal conductors 101A and 102A.

In the prior art, a metal spring contact 104 is inserted between the plates in order to effect an electrical interconnection between conductor pads 101 and 102. The configuration shown in FIG. 1 is typical of the prior art, but is not limitative. The metal spring contact 104 is, typically, fabricated of stainless steel or similar material which is electrically conductive and relatively free from corrosion effects. In addition, the metal spring contact 104 has a substantial resilience or memory factor so that it is strongly urged to expand. Thus, the metal spring contact 104 will engage the upper and lower conductor pads 101 and 102 effectively, both mechanically and electrically.

While it is possible for the spring contact 104 to be physically joined to the respective conductor pads 101 and 102, for example by welding, soldering, or the like, it is frequently the case that the spring contacts are merely retained in place by means of a friction or force fit. That is, the springs 104 are designed to have substantial resiliency and sufficient spring force to be maintained in place. Similarly, the springs 104 are generally designed to have a relatively low mass whereby the chance of dislodgment of the spring is minimal. Over years of practice, this has shown to be a fairly secure method of construction. However, rather expensive and cumbersome tooling is required to insert the springs into the display device. Also, these metal connectors are subject to fatigue and corrosion. Furthermore, this spring and pad arrangement has a minimum pad width and spacing of about 1.27 mm (or 0.05 inches) in order to permit proper contact and alignment. This spacing is relatively large in current technology.

In an alternative prior art technique described in the Kupsky et al U.S. Pat. No. (4,124,926), a conductive silver epoxy is extruded between the plates to produce a connection between the conductors on the surfaces of the plates. However, this is an extremely time consuming and tedious chore usually performed by hand with a syringe and a small needle. Also, different thermal coefficients of expansion (TCE) between the epoxy and the glass substrate can be significant so as to produce breakage of the display, or the like. The epoxy connector also has a rather small range of operating temperatures because epoxy materials, typically, have a lower glass transition temperature (Tg) of about 150° C. or less. If the unit is subjected to higher temperatures, the bond strength thereof can be severely affected. In addition, the epoxy connectors tend to hydrolize and/or breakdown when exposed to UV light.

Figure 2:
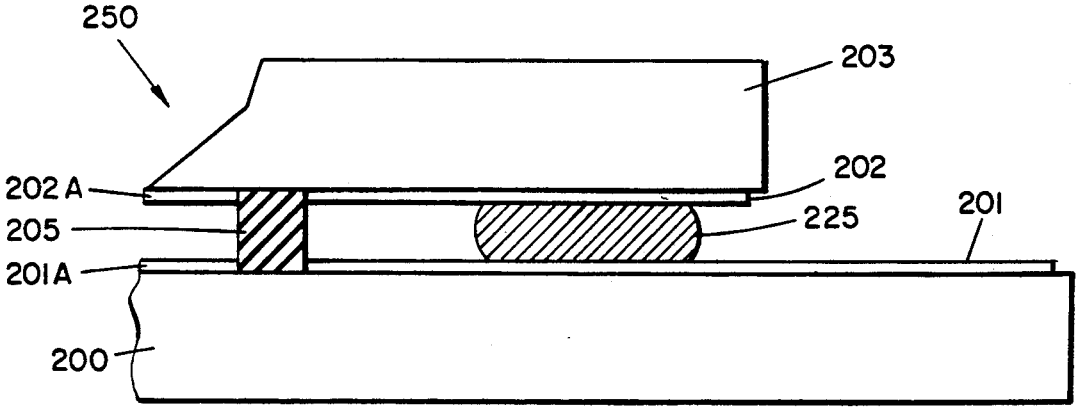
FIG. 2 is a cross sectional view of the two-plate devices such as gas discharge devices, using the screened conductive interconnect.
Figure 3:
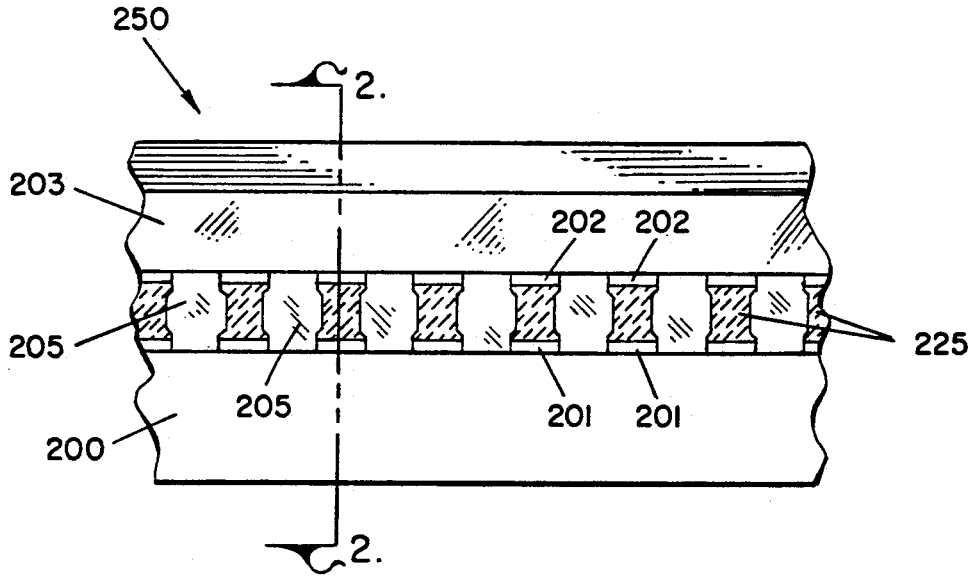
FIG. 3 is an end view or front view of the screened interconnect system of the instant invention.

Reference is made now to FIGS. 2 and 3 concurrently. In FIG. 2, there is shown a partial sectional view of one embodiment of the instant invention. In FIG. 3, there is shown an end view of the same embodiment of the invention. In this embodiment, components which are similar to those as shown in FIG. 1 bear similar reference numerals except in the 200 series.

In this embodiment of the instant invention, there is shown a partial view of a cross-section of a display device which uses the screened-on conductive glass interconnect 225 as the electrical connection between the conductor pads 201 and 202.

More particularily, FIG. 2 depicts an improved display device 250 which includes a substrate 200 and a faceplate 203. The substrate and faceplate are disposed substantially in parallel but spaced apart arrangement relative to each other. Typically, the substrate 200 and the faceplate 203 are fabricated of glass, plastic or any other substantially transparent, electrically insulative, and rigid material.

The facing surfaces of the substrate 200 and faceplate 203 include one or more conductor pads 201 and 202, respectively. Typically, the conductor pads are elongated strips or paths of an electrically conductive material such as tin oxide or the like. The substrate 200 and faceplate 203 are joined together by the seal 205. Typically, the seal 205 is made of a glass frit or the like. The seal 205 extends around at least a portion of the space between the substrate 200 and the faceplate 203. Thus, an enclosed chamber (only a portion of which is shown)

is provided to retain the activatable material which, preferrably, is an appropriate gas such as neon, argon, fluorescent material or the like which produces the appropriate glow, as desired. Also, within the chamber are the electrical conductors 201A and 202A which may represent lead lines, display elements (i.e. anodes and/or cathodes) or the like. This construction is conventional and is described in the prior art including the above mentioned patent to S. T. Tang.

The internal conductors 201A and 202A are electrically joined to (or continuations of) the conductors 201 and 202, respectively. The conductors 201 and 202 are referred to as conductor pads and are used, inter alia, as terminals for the display device 250. For example, the substrate 200 extends beyond the edge of faceplate 203. Thus, the conductor pads 201 are, in essence, exposed. In some instances, the substrate 200 with the conductor pads 201 thereon is adapted to be inserted into a suitable receptacle or socket. In other cases, a suitable connector (not shown) is arranged to abut the conductor pads 201. The conductor pads 201 and 202 are, selectively, connected together by interconnect 225 in order to transfer electrical signals from the external terminal to the conductor pads 201 and 202 and, thus, to the internal conductors 201A and 202A. This conductor is, largely, conventional as noted relative to the description of FIG. 1.

In this invention, the interconnect 225 is formed of conductive solder glass. This type of solder glass is conventional and is comprised of, inter alia, lead oxide, silica, zinc oxide, boron oxide, barium oxide, zirconium oxide, silver, palladium and combinations thereof. In a typical configuration, the interconnects resemble small pillars which extend between the conductor pads 201 and 202 on the respective plates of the display device 250.

Inasmuch as the interconnects 225 are fabricated of glass-based material, similar to the display plates, the glass frit seal 205 and the like, the TCE of the materials are substantially identical which inhibits cracking, crazing, breaking or the like.

This operation and product is achieved with very little interruption of existing technology. For example, the conventional process of preparing the respective faceplate 203 and substrate 200 is maintained. That is, the conductors 201 and 202, inter alia, are produced on the respective plates in the conventional manner and the conductors are fired.

The solder glass is then screened onto the plate (or plates) over the contact pads using thick film screening processes. In the case of a relatively narrow opening or gap between the plates 200 and 203, e.g. about 0.3 mm., the solder glass is screened onto only one of the plates. A conventional screen and screening process is used. The screen includes apertures therethrough which are aligned with the appropriate conductors. The solder glass is screened onto the surface of the plate through the screen. A preglaze operation is utilized whereby the solder glass is dried but not fired. Thereafter, the glass frit for seal 205 is screened onto the plate through a separate screen. This glass layer is also dried but not fired (i.e. a preglaze operation).

The separate plates are then placed adjacent to and in proper alignment with each other and fired to devitrify the solder glass interconnect and the glass frit seal. When the solder glass material is fired (devitrified), it becomes glass-ceramic-like and the glass transition temperature is raised to a point above the initial 450° C. seal temperature. The device is then tubulated, beveled, baked and so forth in accordance with a conventional method of fabrication.

In the case wherein the gap or space between the plates is somewhat larger, the process of screening the solder glass interconnect (and perhaps the glass frit seal) can be separately performed on the respective surface of each of the plates. Thus, a relatively low pillar of glass solder is required on each of the two facing surfaces (rather than a single relatively tall, and unstable, pillar of solder glass on one plate). Thereafter, the fabrication process of the devices is the same as described supra.

This type of interconnect and method of producing same has clear advantages over the prior art. For example, the TCE for the several parts of the display device is virtually identical thereby minimizing the possibility of breakage due to thermal considerations. Also, the components are joined together to add mutual strength to each other. Further, there is no chance of corrosion at the interconnects. Also, the fabrication of the interconnects is quite fast and economical, rather than slow and laborious. Also, this product has a relatively wide range of operating temperatures, e.g. −40° C. to +400° C., and the materials do not tend to oxidize (metal), carbonize (organic) or hydrolyze (epoxy) as happens in the prior art devices. Nor does the instant invention absorb water or breakdown under IV light. Last, but not least, this interconnect technique permits contact pads on the order of 0.5 mm. in width with 0.5 mm. spacing therebetween. This spacing is not achievable, reliably and economically, in the prior art.

Thus, there is shown and described a preferred embodiment of the instant invention. While those skilled in the art may conceive of modifications or variations thereto, any such changes which fall within the purview of this description are intended to be included therein as well. For example, the activatable material can include liquid crystals or other materials not specifically recited supra. This description is intended to be illustrative only and is not intended to be limitative of the invention. Rather, the scope of the invention is limited only by the scope of the claims appended hereto.

I claim:

1. An interconnect system for electrically interconnecting electrical conductors on parallel plates comprising, first and second planar plates of substantially electrically non-conducting material, a plurality of closely spaced conductor paths on a surface of each of said first and second planar plates, said conductor paths are on the order of 0.5 mm wide with spacing on the order of 0.5 mm therebetween, said first and second planar plates arranged in parallel, spaced apart relation with the plurality of conductor paths on said first planar plate in alignment with the plurality of conductor paths on said second planar plate, and independent and unsupported interconnections formed of a conductive material having substantially the same thermal coefficiently of thermal expansion as said first and second planar plates and joined to the aligned conductor paths on said first and second planar plates in order to electrically interconnect said aligned conductor paths.

2. The system recited in claim 1 wherein, said first and second planar plates are made of glass.

3. The system recited in claim 1 wherein,
said conductor paths are formed of a thin layer of electrically conducting material.

4. The system recited in claim 2 including,
a glass frit seal formed between said first and second planar plates so as to create a chamber between said first and second planar plates.

5. The system recited in claim 4 including,
an activatable material captured within said chamber.

6. The system recited in claim 5 wherein,
said activatable material undergoes a change in a visual characteristic in response to the application of an electric field thereto.

7. The system recited in claim 6 including,
excitation conductor pads on the surfaces of each of said first and second planar plates,
said excitation conductor pads arranged in alignment with each other thereby to selectively apply an electric field to said activatable material in response to the application of an electrical signal to said excitation conductor pads.

8. The system recited in claim 7 wherein,
at least some of said excitation conductor pads are connected to said conductor paths.

9. The system recited in claim 6 wherein,
said first and second planar plates, together with said activatable material, form a gas discharge display device.

10. The system recited in claim 4 wherein,
said interconnections are disposed at the edges of said first and second planar plates and outside said chamber.

11. An interconnect system between high density conductive paths on a pair of relatively widely spaced apart glass substrates in a display device comprising,
a plurality of independent, unsupported, and highly electrically conductive, pillars of devitrified and fired solder glass interposed between respective conductive paths on surfaces of both of said pair of glass substrates wherein said glass substrates are spaced apart by at least 0.3 mm.

12. A method of forming a high density electrical interconnection arrangement between a pair of parallel, planar glass plates having a plurality of closely spaced conductor paths on each of the adjacent surfaces of said plates comprising,
screening a layer of conductive glass onto each conductor path which is to be interconnected on at least one of said pair of parallel planar plates,
said screening step comprises a thick film process,
drying said layer of conductive glass in a preglaze operation,
placing said pair of plates in parallel relationship with the conductor paths of both plates aligned with each other, and
firing said conductive glass to devitrify same.

13. The method recited in claim 12 including,
screening a layer of conductive glass on to the aligned conductor paths of both of said pair of parallel planar plates.

14. The system recited in claim 1 wherein,
said conductive material comprises solder glass which includes components from the group including lead oxide, silica, zinc oxide, boron oxide, barium oxide, zirconium oxide, silver and palladium.

15. The method recited in claim 12 including,
screening a glass frit layer onto at least one of said pair of parallel plates to form a pattern which excludes said layer of conductive glass on said conductor paths.

* * * * *